US011731854B2

(12) United States Patent
Kim

(10) Patent No.: US 11,731,854 B2
(45) Date of Patent: Aug. 22, 2023

(54) CHUCK ASSEMBLY FOR HOLDING A REEL

(71) Applicant: LG Energy Solution, Ltd., Seoul (KR)

(72) Inventor: Jong Min Kim, Hudsonville, MI (US)

(73) Assignee: LG Energy Solution, Ltd., Seoul (KR)

( * ) Notice: Subject to any disclaimer, the term of this patent is extended or adjusted under 35 U.S.C. 154(b) by 0 days.

(21) Appl. No.: 17/577,588

(22) Filed: Jan. 18, 2022

(65) Prior Publication Data

US 2023/0051008 A1 Feb. 16, 2023

Related U.S. Application Data

(60) Provisional application No. 63/231,469, filed on Aug. 10, 2021.

(51) Int. Cl.
*B65H 75/24* (2006.01)

(52) U.S. Cl.
CPC ..... *B65H 75/247* (2013.01); *B65H 75/2484* (2021.05)

(58) Field of Classification Search
None
See application file for complete search history.

(56) References Cited

U.S. PATENT DOCUMENTS 1,973,980 A * 9/1934 Graffenberger ..... B65H 75/242 242/573.3
2,908,452 A * 10/1959 Jacobsen ..... B65H 75/242 242/573.4
3,239,160 A * 3/1966 Cowles ..... H01F 41/098 242/575.2
3,552,673 A * 1/1971 Evers ..... B65H 75/242 242/571.3
3,815,836 A * 6/1974 Munnekehoff ..... B65H 54/543 242/575.3
4,193,633 A * 3/1980 Potter ..... B65H 75/246 279/2.2
4,334,652 A * 6/1982 Blackburn ..... B65H 75/246 242/571.5
4,465,244 A * 8/1984 Karr ..... B65H 75/242 279/2.03
2008/0237388 A1 10/2008 Klinke
2012/0270716 A1 10/2012 Kauppila
(Continued)

FOREIGN PATENT DOCUMENTS

JP 2003160268 A 6/2003
WO 2013128479 A1 9/2013

*Primary Examiner* — William A. Rivera
(74) *Attorney, Agent, or Firm* — Buckert Patent & Trademark Law Firm PC; John F. Buckert

(57) ABSTRACT

A chuck assembly for holding a reel is provided. The chuck assembly includes a tubular wall defining a central hole therethrough and extending along a longitudinal axis. The chuck assembly includes a flange member that is coupled to a first end portion of the tubular wall. The chuck assembly includes first, second, third, fourth, fifth, and sixth ball roller assemblies that are coupled to the tubular wall. The chuck assembly further includes first, second, third, fourth, fifth, and sixth gripper assemblies that are coupled to the tubular wall. The second ball roller assembly is spaced 60 degrees apart from the first ball roller assembly relative to the longitudinal axis and is disposed between the first and second gripper assemblies.

10 Claims, 18 Drawing Sheets

(56) References Cited

U.S. PATENT DOCUMENTS

| | | | | |
|---|---|---|---|---|
| 2014/0042262 | A1* | 2/2014 | Li | B65H 75/246<br>242/571 |
| 2019/0023525 | A1* | 1/2019 | Van Deurse | B65H 75/4484 |
| 2019/0292004 | A1 | 9/2019 | Lee et al. | |

* cited by examiner

CHUCK ASSEMBLY FOR HOLDING A REEL

CROSS-REFERENCE TO RELATED APPLICATIONS

This application claims priority to U.S. Provisional Patent Application No. 63/231,469 filed on Aug. 10, 2021, the entire contents of which are hereby incorporated by reference herein.

BACKGROUND

A chuck assembly could become damaged such that a reel on the assembly could not be easily removed.

The inventor herein has recognized a need for an improved chuck assembly that minimizes or eliminates the above-mentioned problem.

SUMMARY

A chuck assembly for holding a reel in accordance with an exemplary embodiment is provided. The chuck assembly includes a tubular wall defining a central hole therethrough. The tubular wall extends along a longitudinal axis. The chuck assembly further includes a flange member that is coupled to a first end portion of the tubular wall. The chuck assembly further includes first, second, third, fourth, fifth, and sixth ball roller assemblies that are coupled to the tubular wall. The chuck assembly further includes first, second, third, fourth, fifth, and sixth gripper assemblies that are coupled to the tubular wall. The second ball roller assembly is spaced 60 degrees apart from the first ball roller assembly relative to the longitudinal axis and is disposed between the first and second gripper assemblies. The third ball roller assembly is spaced 60 degrees apart from the second ball roller assembly relative to the longitudinal axis and is disposed between the second and third gripper assemblies. The fourth ball roller assembly is spaced 60 degrees apart from the third ball roller assembly relative to the longitudinal axis and is disposed between the third and fourth third gripper assemblies. The fifth ball roller assembly is spaced 60 degrees apart from the fourth ball roller assembly relative to the longitudinal axis and is disposed between the fourth and fifth gripper assemblies. The sixth ball roller assembly is spaced 60 degrees apart from the fifth ball roller assembly relative to the longitudinal axis and is disposed between the fifth and sixth gripper assemblies. The first ball roller assembly is spaced 60 degrees apart from the sixth ball roller assembly relative to the longitudinal axis and is disposed between the first and sixth gripper assemblies.

A chuck assembly for holding a reel in accordance with an exemplary embodiment is provided. The chuck assembly includes a tubular wall defining a central hole therethrough. The tubular wall extends along a longitudinal axis. The chuck assembly further includes a flange member that is coupled to a first end portion of the tubular wall. The chuck assembly further includes first, second, and third ball roller assemblies that are coupled to the tubular wall. The first, second, and third ball roller assemblies are disposed apart from one another at a respective predetermined angle about the longitudinal axis. The chuck assembly further includes first, second, and third gripper assemblies being coupled to the tubular wall. The first, second, and third gripper assemblies are disposed apart from one another at the respective predetermined angle about the longitudinal axis.

DETAILED DESCRIPTION

Figure 1:
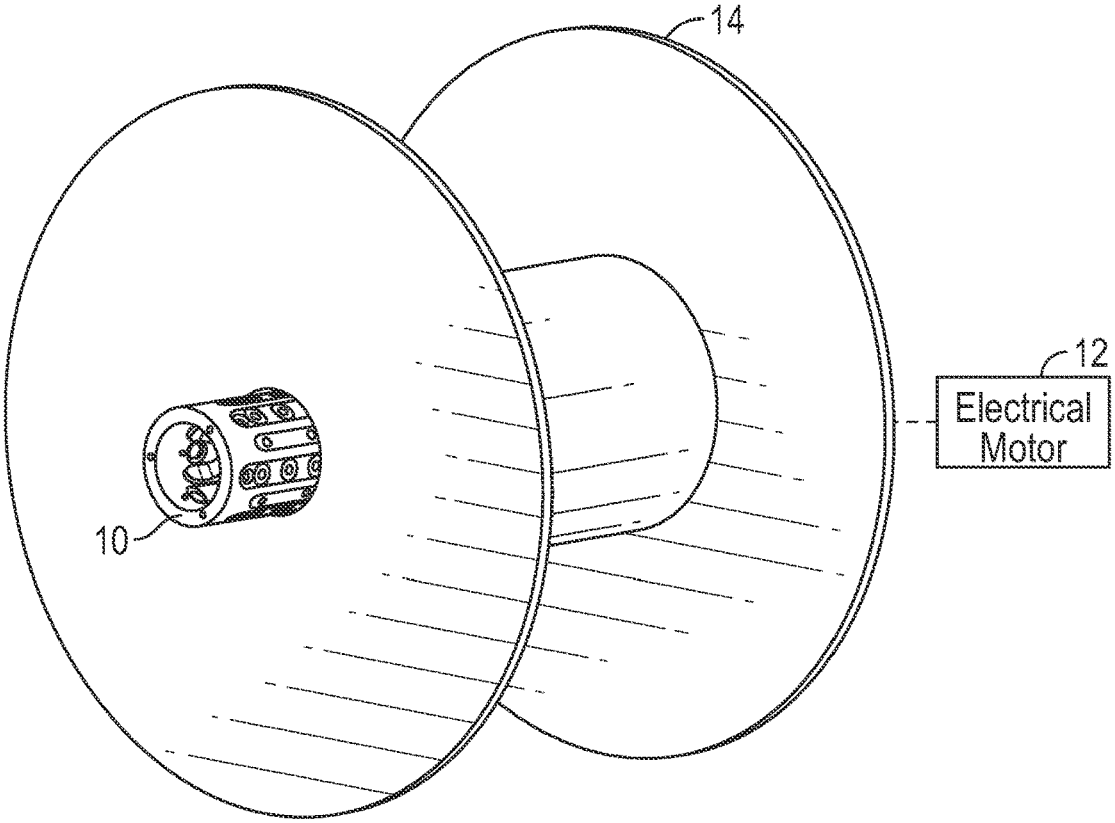
FIG. 1 is an isometric view of a chuck assembly in accordance with an exemplary embodiment, a reel disposed on the chuck assembly, and an electrical motor that rotates the chuck.
Figure 2:
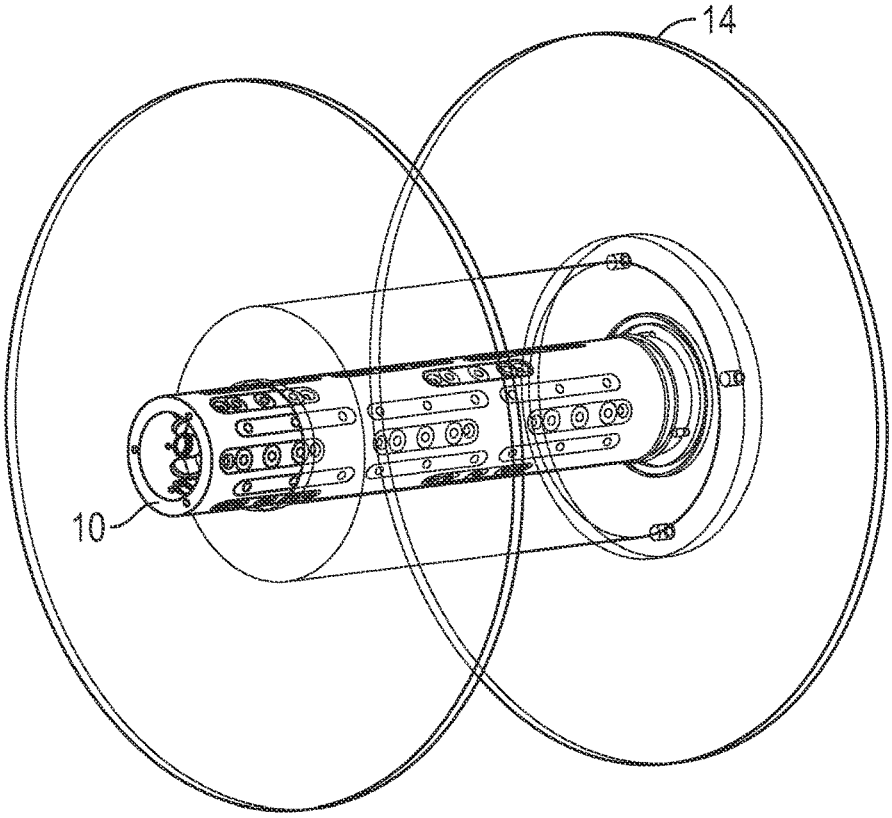
FIG. 2 is another isometric view of the chuck assembly and the reel of FIG. 1 with the reel being partially transparent.
Figure 3:
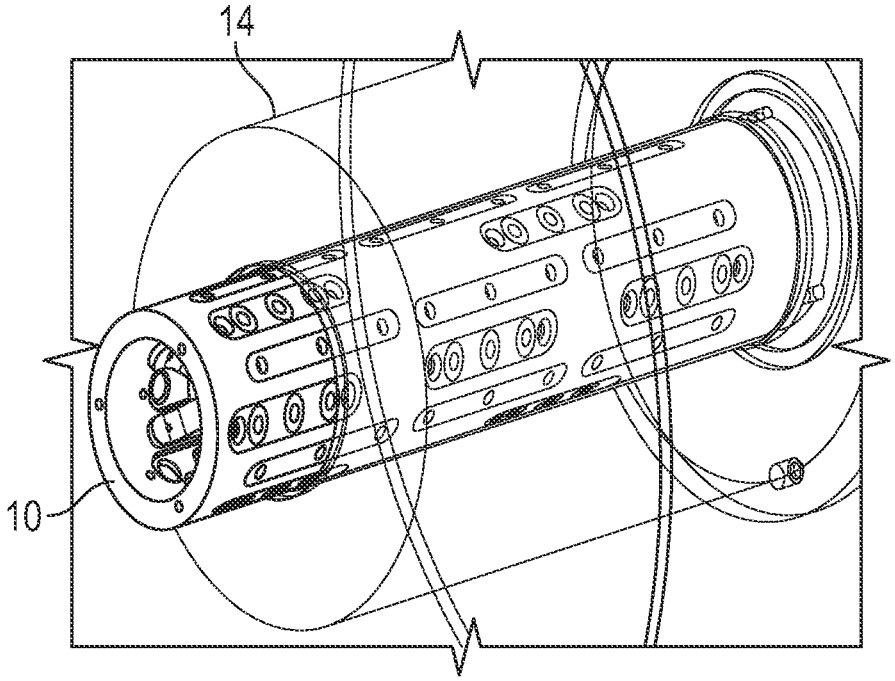
FIG. 3 is an enlarged view of a portion of the chuck assembly and the reel of FIG. 2.
Figure 4:
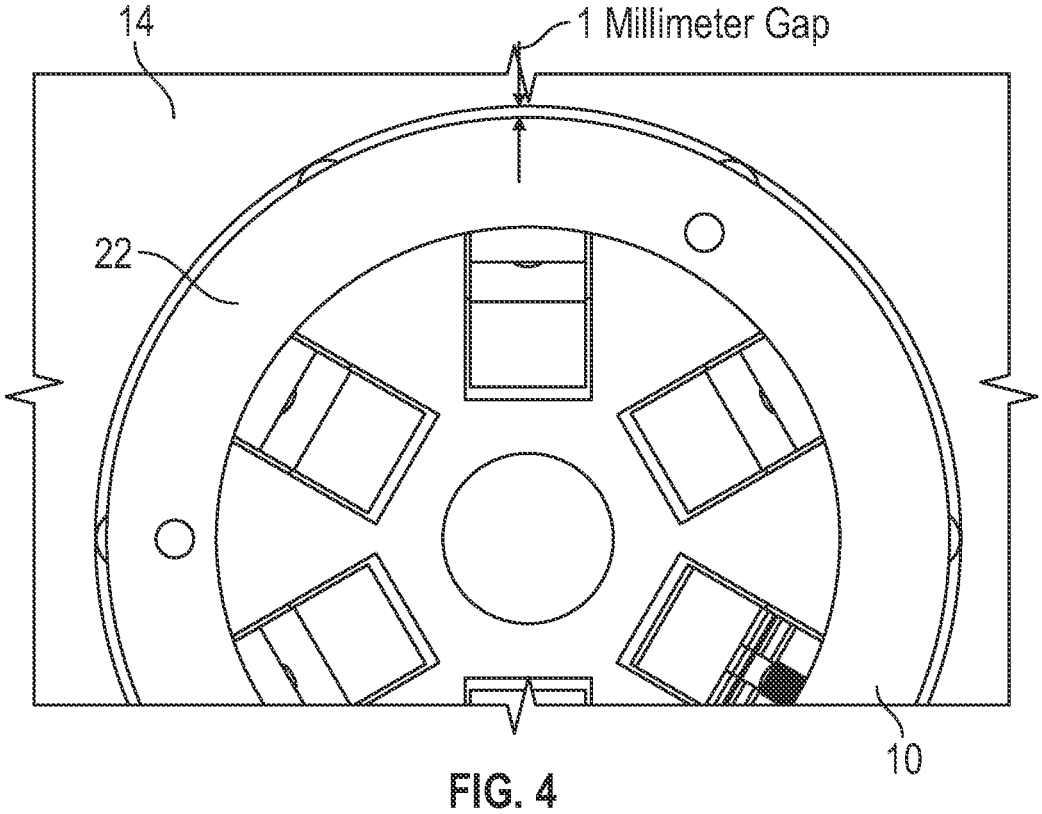
FIG. 4 is an end view of a portion of the chuck assembly and the reel of FIG. 1.

Referring to FIGS. 1-4, a chuck assembly 10 in accordance with an exemplary embodiment that holds a reel 14 thereon is illustrated. The chuck assembly 10 is rotated utilizing the electrical motor 12 that is operably coupled to the chuck assembly 10.

Chuck Assembly

Referring to FIGS. 1, 5, 6 and 10, the chuck assembly 10 is provided to hold the reel 14 thereon and to rotate the reel 14. The chuck assembly 10 includes a tubular wall 22, a flange member 24, ball roller assemblies 25, 26, 27, 28, 29, 30, 31, 32, 33, 34, 35, 36, 37, 38, 39, and gripper assemblies 40, 41, 42, 43, 44, 45.

An advantage of the chuck assembly 10 is that when the reel 14 is inserted on the chuck assembly 10, the reel 14 contacts the ball roller assemblies 25, 26, 27, 28, 29, 30, 31, 32, 33, 34, 35, 36, 37, 38, 39 such that a 1 millimeter gap occurs between the reel 14 and the tubular wall 22 and the reel 14 does not contact the tubular wall 22. Further, in an exemplary embodiment, each set of ball roller assemblies that are longitudinally and linearly aligned with one another are spaced 60 degrees apart from two other sets of ball roller assemblies about a longitudinal axis 47 (shown in FIG. 5). The 1-millimeter gap and the spacing of the ball roller assemblies (e.g., 60 degrees apart) allow the reel 14 to be more easily removed from the chuck assembly 10 when performing maintenance on the chuck assembly 10.

Tubular Wall

Referring to FIGS. 5 and 12-15, the tubular wall 22 includes an outer surface 60, an inner surface 62, a first end portion 64, a second end portion 66, a central hole 68, apertures 81, 82, 83, 91, 92, 101, 102, 103, 111, 112, 121, 122, 123, 131, 132, 141, 142, 143, 151, 152, 153, 161, 162, 163, 171, 172, 173, 181, 182, 183, 191, 192, 193. The tubular wall 22 defines the central hole 68 extending therethrough. The tubular wall 22 extends along the longitudinal axis 47 (shown in FIG. 5). The apertures 81-193 extend through the tubular wall 22 and communicate with the central hole 68.

Flange Member

Figure 5:
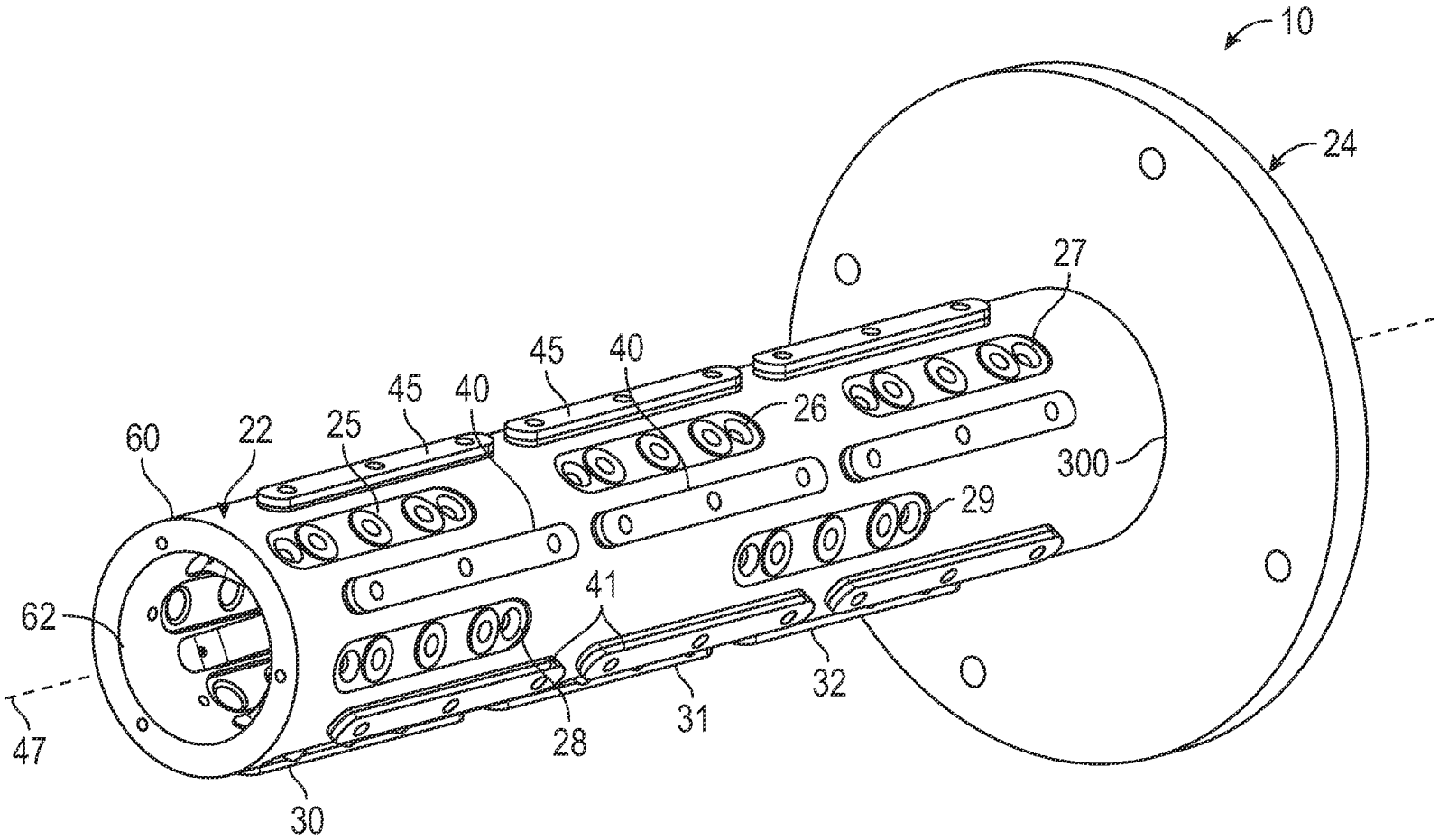
FIG. 5 is an isometric view of the chuck assembly of FIG. 1.
Figure 12:
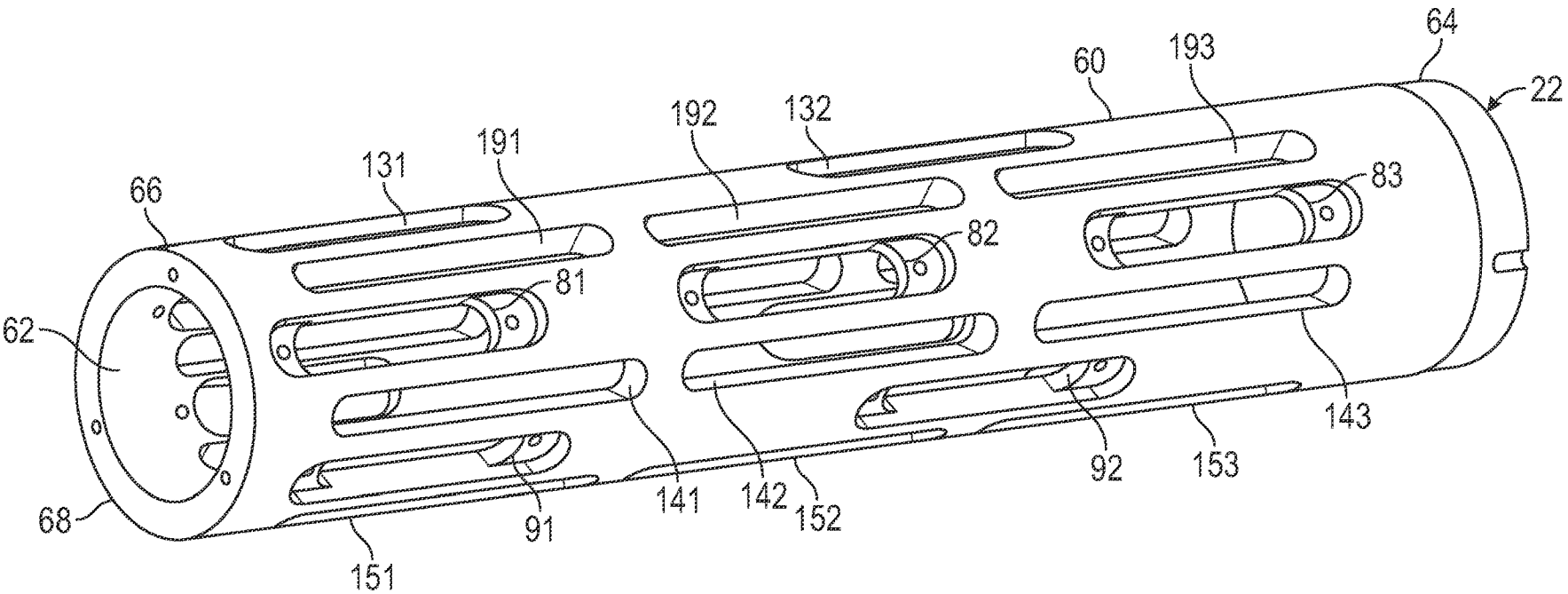
FIG. 12 is an isometric view of a tubular wall utilized in the chuck assembly of FIG. 5.

Referring to FIGS. 5 and 12, the flange member 24 is coupled to the first end portion 64 of the tubular wall 22. The flange member 24 is disc-shaped and includes a central aperture 300 extending therethrough that receives the first end portion 64 therein. The flange member 24 is coupled to the tubular wall 22 utilizing bolts.

Ball Roller Assemblies

Referring to FIGS. 5, 6 and 16-19, the ball roller assemblies 25-39 are provided to allow the reel 14 to be removably coupled to the tubular wall 22. Since the structure of the ball roller assemblies 25-39 are identical to one another, only the structure of the ball roller assembly 25 will be discussed in greater detail herein.

Figure 16:
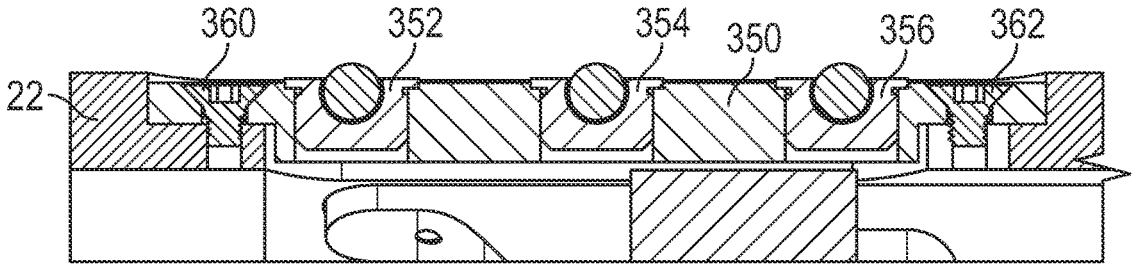
FIG. 16 is a cross-sectional view of a ball roller assembly and a portion of the tubular wall utilized in the chuck assembly of FIG. 5.
Figure 17:
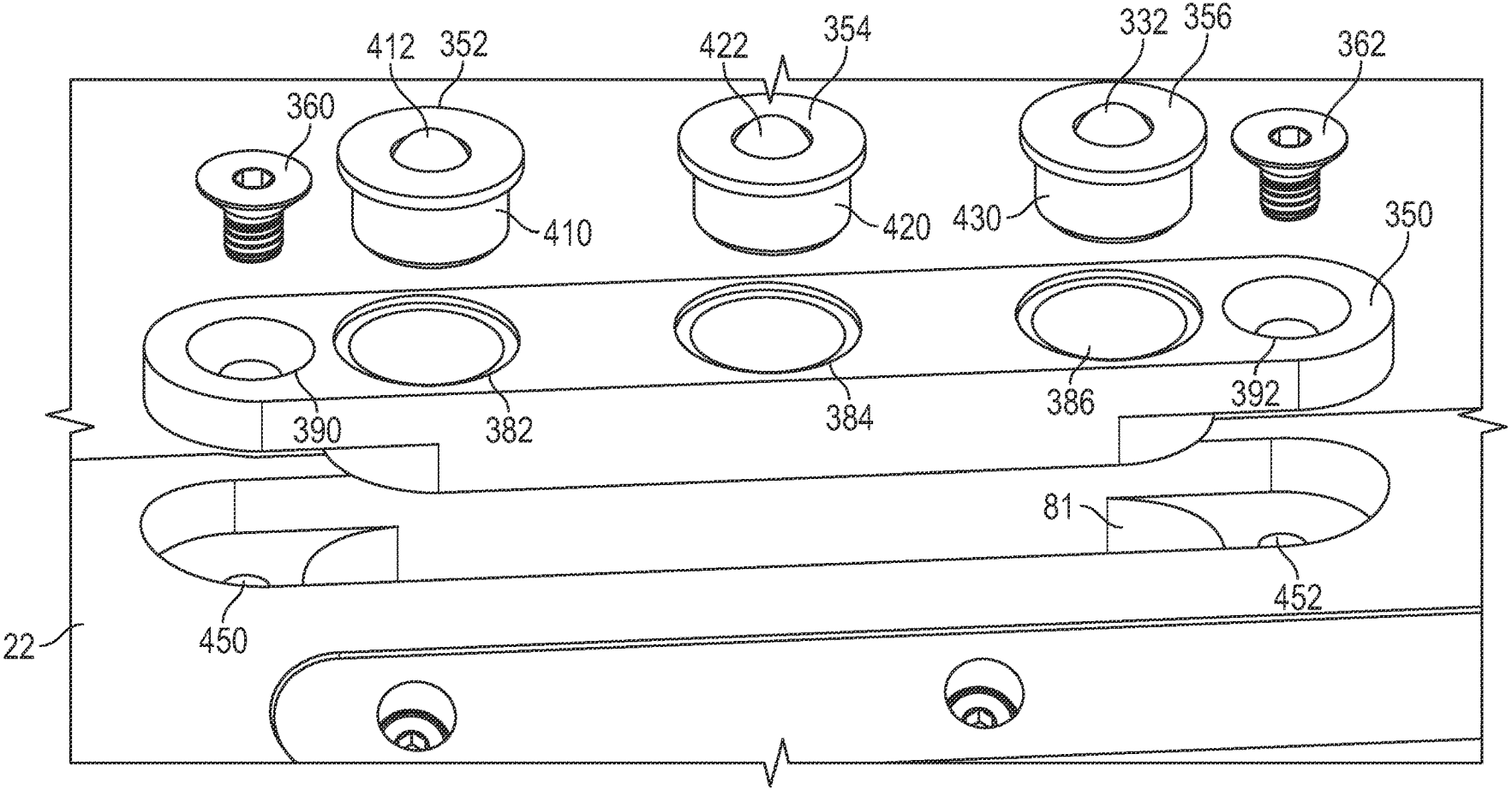
FIG. 17 is an exploded view of the ball roller assembly of FIG. 16 and a portion of the tubular wall utilized in the chuck assembly of FIG. 5.

Referring to FIGS. 5, 16 and 17, the ball roller assembly 25 is coupled to the tubular wall 22 and is at least partially disposed in the aperture 81 (shown in FIG. 12) of the tubular wall 22. The ball roller assembly 25 includes a ball roller block 350, ball rollers 352, 354, 356, and bolts 360, 362. The ball roller block 350 includes apertures 382, 384, 386, 390, 392 extending therethrough.

Figure 18:
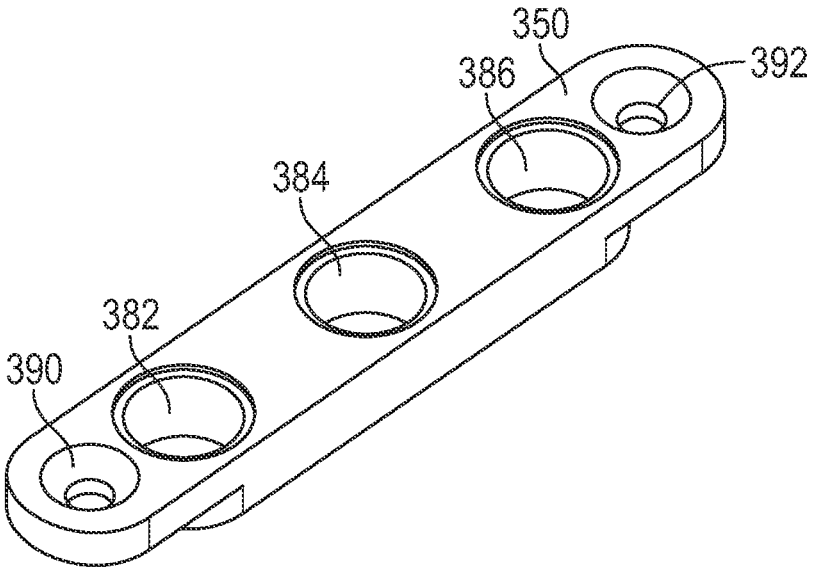
FIG. 18 is an isometric view of a ball roller block utilized in the ball roller assembly of FIG. 16.
Figure 19:
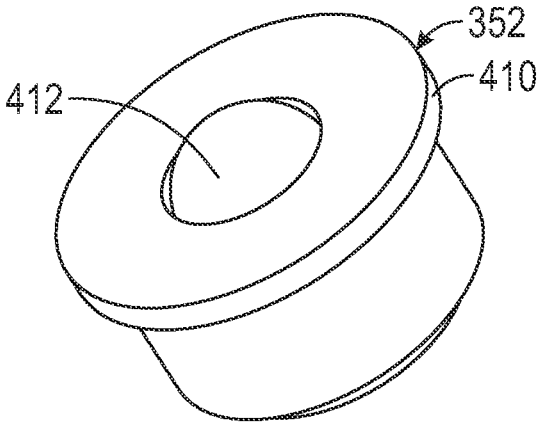
FIG. 19 is an isometric view of a ball roller utilized in the ball roller assembly of FIG. 16.

Referring to FIGS. 17-19, the ball roller 352 is provided to allow the reel 14 to slide relative to the tubular wall 22, without contacting the tubular wall 22, when a user removes the reel 14 from the tubular wall 22. The ball roller 352 includes a housing 410 and a ball bearing 412 that is rotatably coupled to the housing 410. The housing 410 is disposed within the aperture 382 in the ball roller block 350 such that an outer surface of the ball bearing 412 extends radially outwardly from the outer surface 60 of the tubular wall 22 a first predetermined distance. In an exemplary embodiment, the predetermined distance is 1-millimeter.

The ball roller 354 is provided to allow the reel 14 to slide relative to the tubular wall 22, without contacting the tubular wall 22, when a user removes the reel 14 from the tubular wall 22. The ball roller 354 includes a housing 420 and a ball bearing 422 that is rotatably coupled to the housing 420. The housing 420 is disposed within the aperture 384 in the ball roller block 350 such that an outer surface of the ball bearing 422 extends radially outwardly from the outer surface 60 of the tubular wall 22 the first predetermined distance. In an exemplary embodiment, the predetermined distance is 1 mm.

The ball roller 356 is provided to allow the reel 14 to slide relative to the tubular wall 22, without contacting the tubular wall 22, when a user removes the reel 14 from the tubular wall 22. The ball roller 356 includes a housing 430 and a ball bearing 432 that is rotatably coupled to the housing 430. The housing 430 is disposed within the aperture 386 in the ball roller block 350 such that an outer surface of the ball bearing 432 extends radially outwardly from the outer surface 60 of the tubular wall 22 the first predetermined distance. In an exemplary embodiment, the predetermined distance is 1 mm.

The bolt 360 is provided to couple the ball roller block 350 to the tubular wall 22. The bolt 360 extends through the aperture 390 of the ball roller block 350 and into a threaded aperture 450 in the tubular wall 22.

The bolt 362 is provided to couple the ball roller block 350 to the tubular wall 22. The bolt 362 extends through the aperture 392 of the ball roller block 350 and into aperture 452 in the tubular wall 22.

Figure 10:
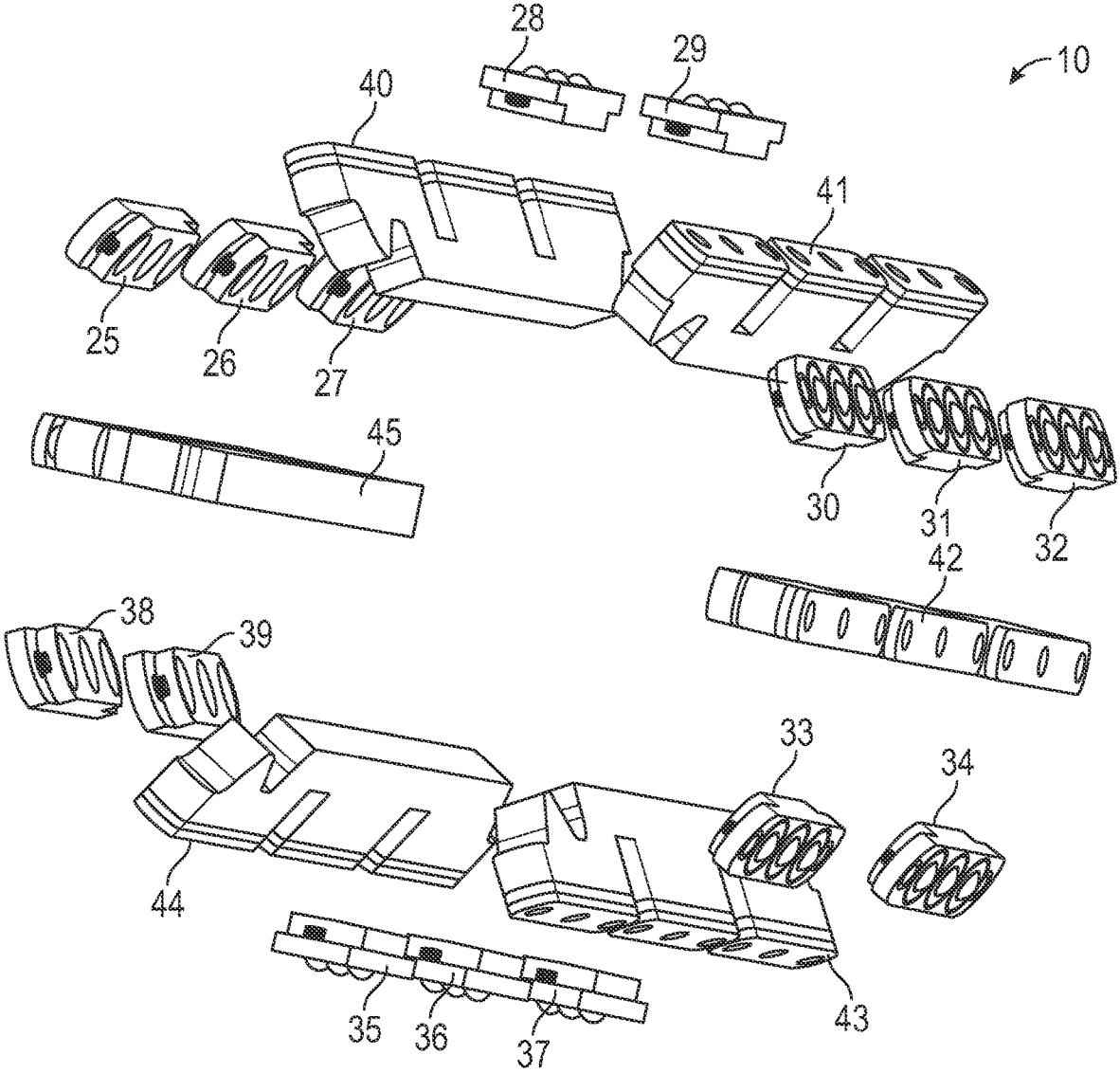
FIG. 10 is an exploded view of a portion of the chuck assembly of FIG. 5 illustrating ball roller assemblies and gripper assemblies utilized therein.
Figure 11:
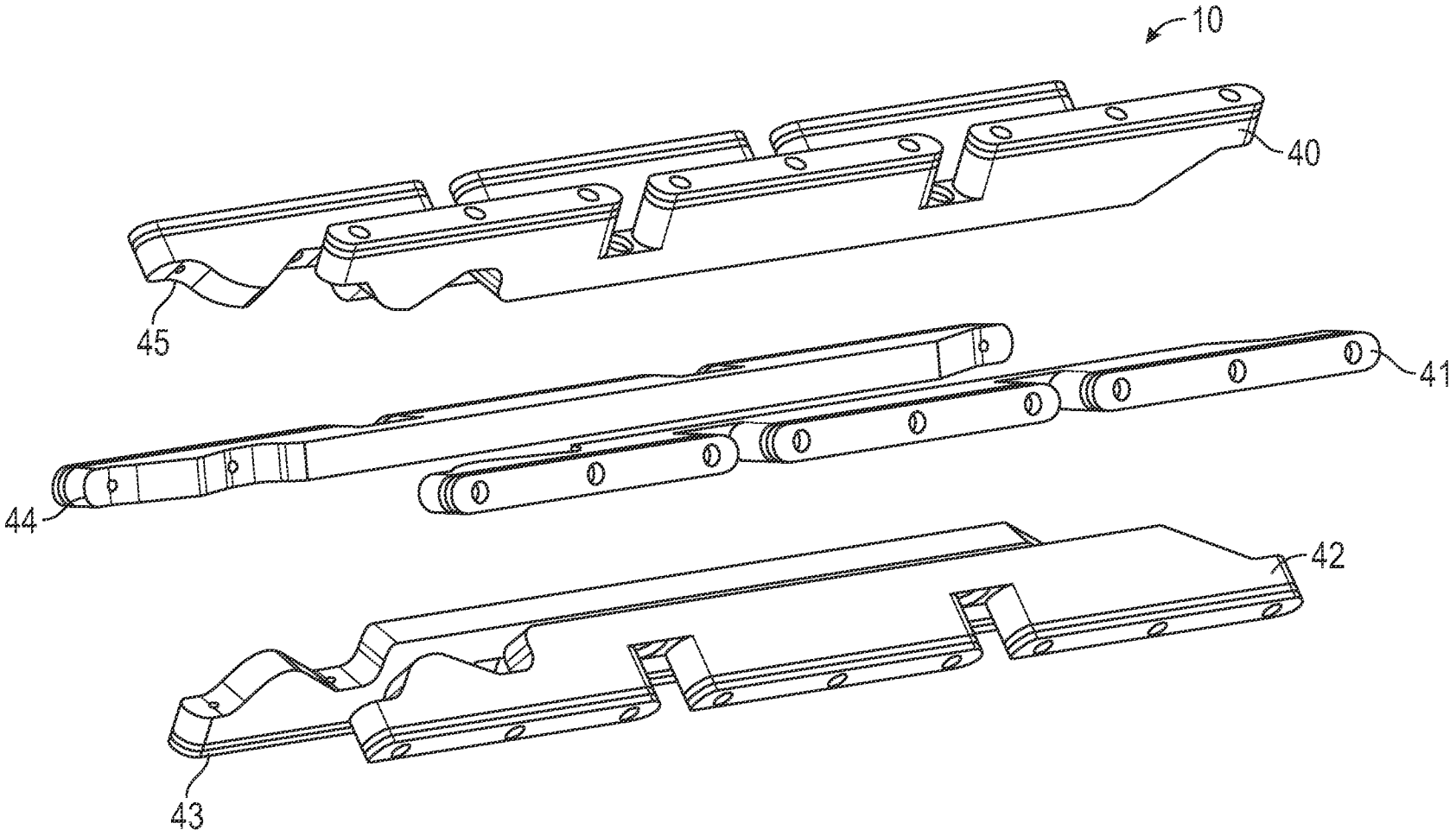
FIG. 11 is an exploded view of a portion of the chuck assembly of FIG. 5 illustrating gripper assemblies utilized therein.

Referring to FIGS. 5, 10 and 12, the ball roller assembly 26 is coupled to the tubular wall 22 and is at least partially disposed in the aperture 82 of the tubular wall 22. The ball roller assembly 26 is spaced 60 degrees apart from the ball roller assemblies 38, 39 relative to the longitudinal axis 47 and is disposed between the gripper assemblies 40, 45.

The ball roller assembly 27 is coupled to the tubular wall 22 and is at least partially disposed in the aperture 83 of the tubular wall 22. The ball roller assembly 27 is spaced 60 degrees apart from the ball roller assemblies 28, 39 relative to the longitudinal axis 47 and is disposed between the gripper assemblies 40, 45.

The ball roller assembly 28 is coupled to the tubular wall 22 and is at least partially disposed in the aperture 91 of the tubular wall 22. The ball roller assembly 28 is spaced 60 degrees apart from the ball roller assemblies 25, 26, 27 relative to the longitudinal axis 47 and is disposed between the gripper assemblies 40, 41.

The ball roller assembly 29 is coupled to the tubular wall 22 and is at least partially disposed in the aperture 92 of the tubular wall 22. The ball roller assembly 29 is spaced 60 degrees apart from the ball roller assemblies 25, 26, 27 relative to the longitudinal axis 47 and is disposed between the gripper assemblies 40, 41.

Figure 13:
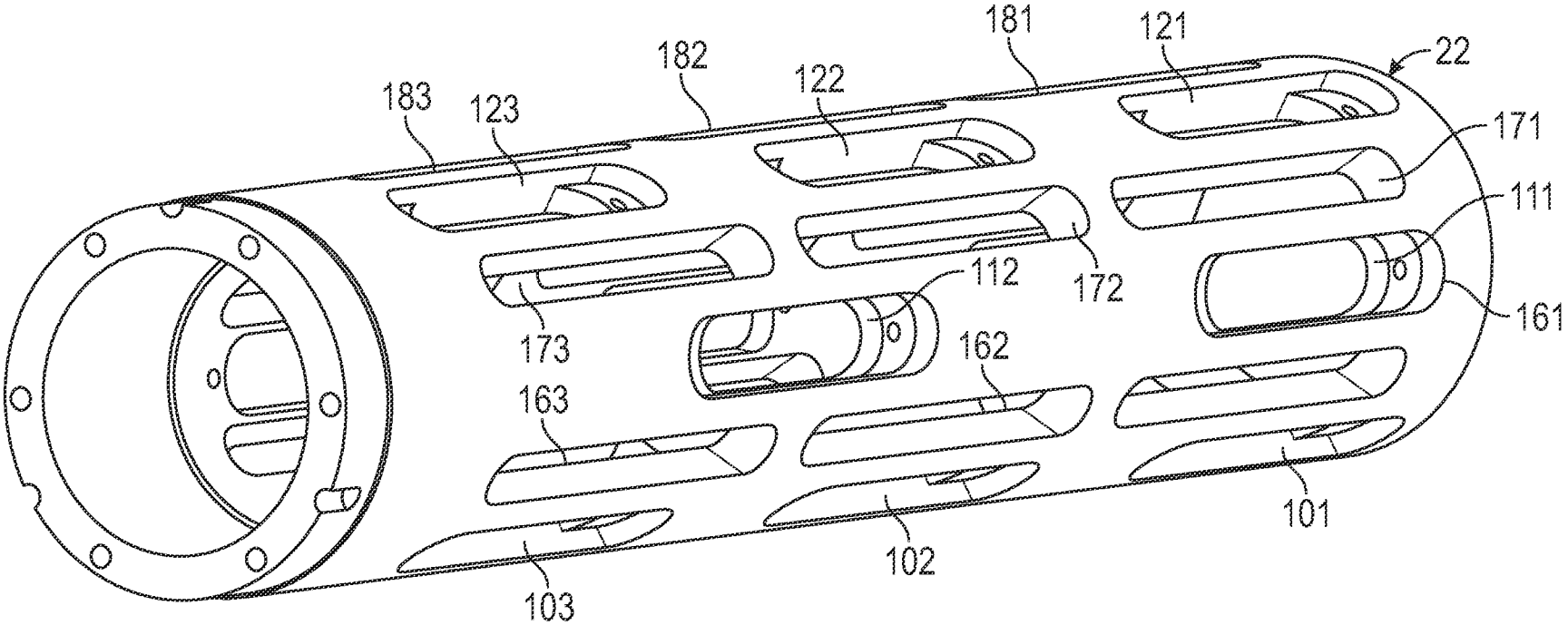
FIG. 13 is another isometric view of the tubular wall of FIG. 12.
Figure 14:
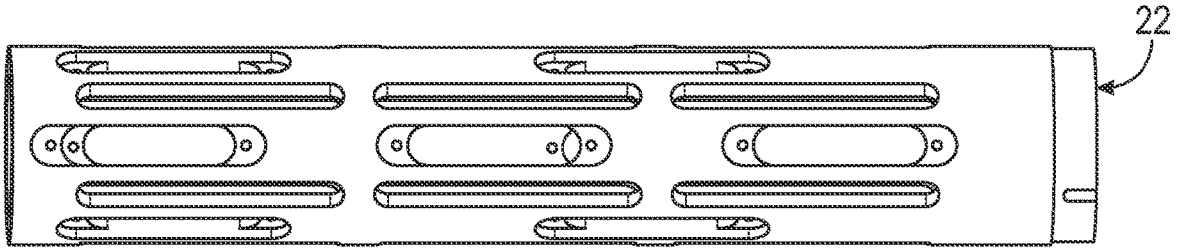
FIG. 14 is a side view of the tubular wall of FIG. 12.
Figure 15:
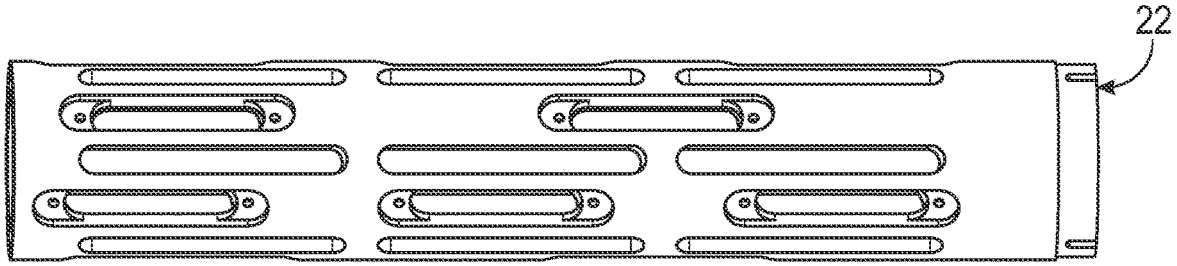
FIG. 15 is another side view of the tubular wall of FIG. 12.

Referring to FIGS. 5, 10 and 13, the ball roller assembly 30 is coupled to the tubular wall 22 and is at least partially disposed in the aperture 101 of the tubular wall 22. The ball roller assembly 30 is spaced 60 degrees apart from the ball roller assemblies 28, 29 relative to the longitudinal axis 47 and is disposed between the gripper assemblies 41, 42.

The ball roller assembly 31 is coupled to the tubular wall 22 and is at least partially disposed in the aperture 102 of the tubular wall 22. The ball roller assembly 31 is spaced 60 degrees apart from the ball roller assemblies 28, 29 relative to the longitudinal axis 47 and is disposed between the gripper assemblies 41, 42.

The ball roller assembly 32 is coupled to the tubular wall 22 and is at least partially disposed in the aperture 103 of the tubular wall 22. The ball roller assembly 32 is spaced 60 degrees apart from the ball roller assemblies 28, 29 relative to the longitudinal axis 47 and is disposed between the gripper assemblies 41, 42.

Figure 6:
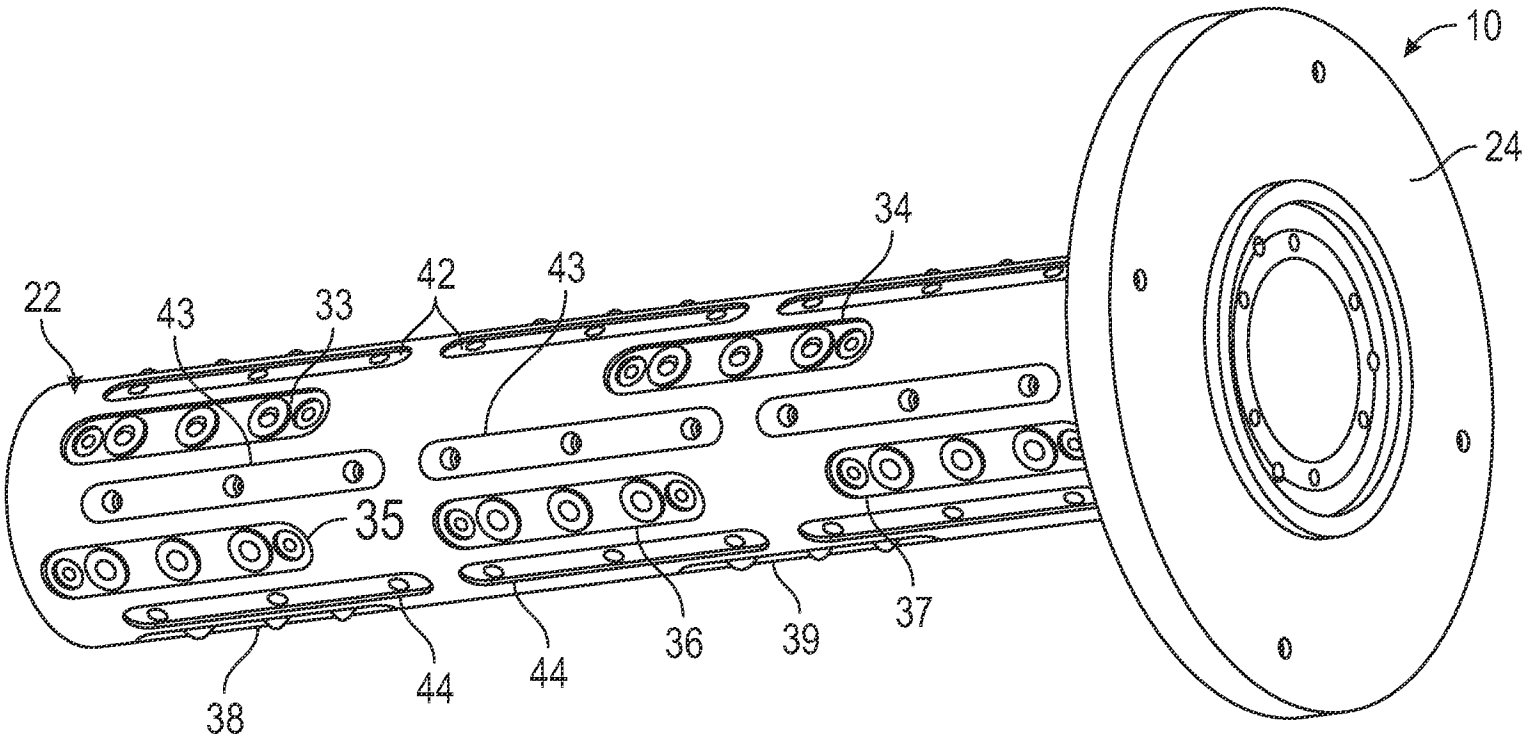
FIG. 6 is another isometric view of the chuck assembly of FIG. 1.
Figure 7:
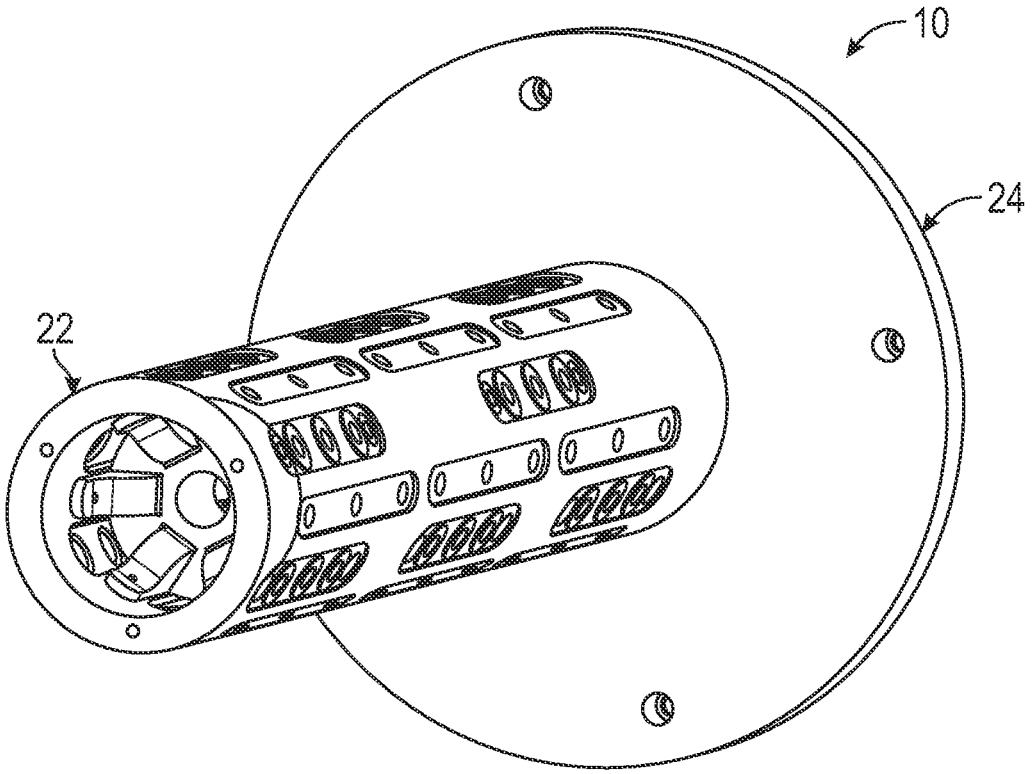
FIG. 7 is another isometric view of the chuck assembly of FIG. 1.
Figure 8:
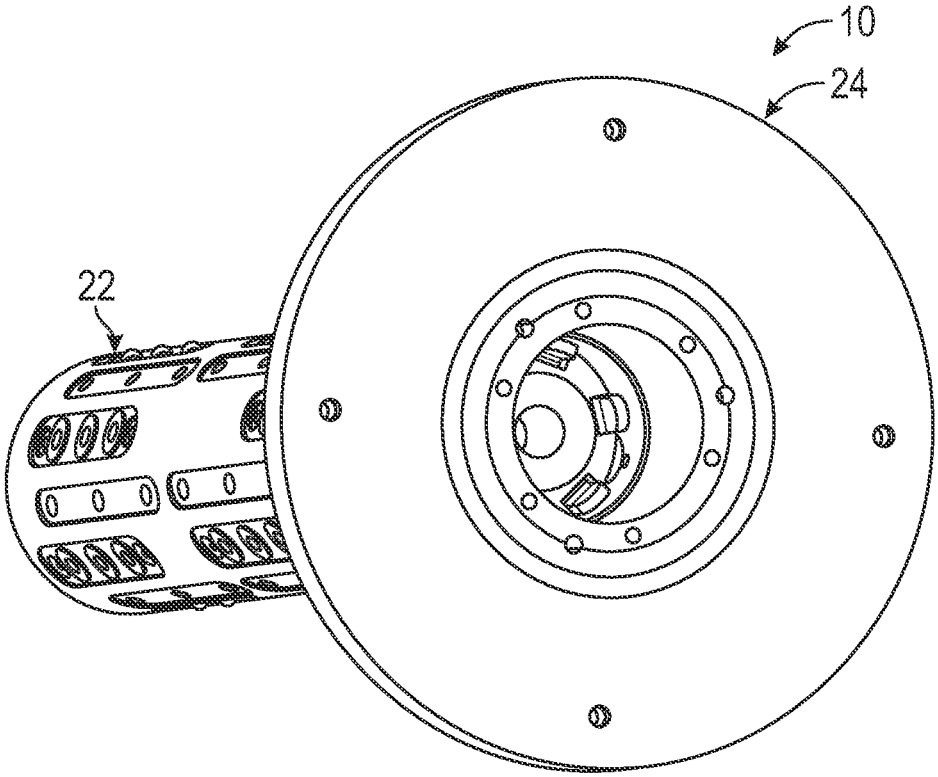
FIG. 8 another isometric view of the chuck assembly of FIG. 1.
Figure 9:
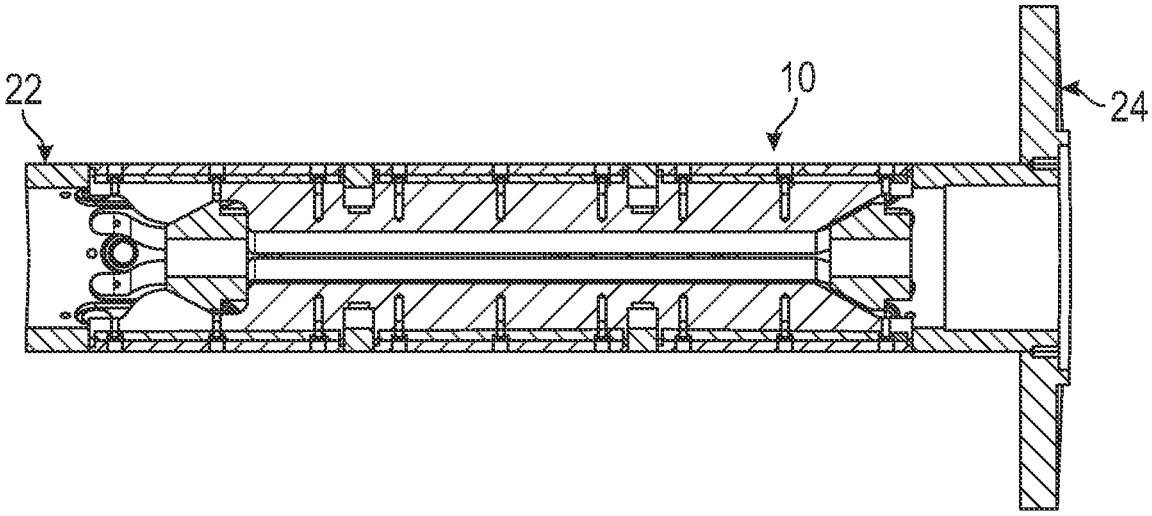
FIG. 9 is a cross-sectional view of the chuck assembly of FIG. 1.

Referring to FIGS. 6, 10 and 13, the ball roller assembly 33 is coupled to the tubular wall 22 and is at least partially disposed in the aperture 111 of the tubular wall 22. The ball roller assembly 33 is spaced 60 degrees apart from the ball roller assemblies 30, 31, 32 relative to the longitudinal axis 47 (shown in FIG. 5) and is disposed between the gripper assemblies 42, 43.

The ball roller assembly 34 is coupled to the tubular wall 22 and is at least partially disposed in the aperture 112 of the tubular wall 22. The ball roller assembly 34 is spaced 60 degrees apart from the ball roller assemblies 30, 31, 32 relative to the longitudinal axis 47 (shown in FIG. 5) and is disposed between the gripper assemblies 42, 43.

The ball roller assembly 35 is coupled to the tubular wall 22 and is at least partially disposed in the aperture 121 of the tubular wall 22. The ball roller assembly 35 is spaced 60 degrees apart from the ball roller assemblies 33, 34 relative to the longitudinal axis 47 (shown in FIG. 5) and is disposed between the gripper assemblies 43, 44.

The ball roller assembly 36 is coupled to the tubular wall 22 and is at least partially disposed in the aperture 122 of the tubular wall 22. The ball roller assembly 36 is spaced 60 degrees apart from the ball roller assemblies 33, 34 relative to the longitudinal axis 47 (shown in FIG. 5) and is disposed between the gripper assemblies 43, 44.

The ball roller assembly 37 is coupled to the tubular wall 22 and is at least partially disposed in the aperture 123 of the tubular wall 22. The ball roller assembly 37 is spaced 60 degrees apart from the ball roller assemblies 33, 34 relative to the longitudinal axis 47 (shown in FIG. 5) and is disposed between the gripper assemblies 43, 44.

Referring to FIGS. 6, 10 and 12, the ball roller assembly 38 is coupled to the tubular wall 22 and is at least partially disposed in the aperture 131 of the tubular wall 22. The ball roller assembly 38 is spaced 60 degrees apart from the ball roller assemblies 35, 36, 37 relative to the longitudinal axis 47 (shown in FIG. 5) and is disposed between the gripper assemblies 44, 45.

The ball roller assembly 39 is coupled to the tubular wall 22 and is at least partially disposed in the aperture 132 of the tubular wall 22. The ball roller assembly 39 is spaced 60 degrees apart from the ball roller assemblies 35, 36, 37 relative to the longitudinal axis 47 (shown in FIG. 5) and is disposed between the gripper assemblies 44, 45.

Gripper Assemblies

Referring to FIGS. 5, 6 and 20-29, the gripper assemblies 40-45 are provided to contact an inner surface of the reel 14 such that the chuck assembly 10 rotates the reel 14 when the chuck assembly 10 is rotated by the electrical motor 12. Since the structure of the gripper assemblies 40-45 are identical to one another, only the structure of the gripper assembly 40 will be discussed in greater detail herein.

Referring to FIGS. 20-26, the gripper assembly 40 includes a gripper housing 600, replaceable gripper blocks 602, 604, 606, bolts 610, 612, 614, 616, 618, 620, 622, 624, 626, and replaceable rubber pads 702, 704, 706.

Gripper Housing

Figure 20:
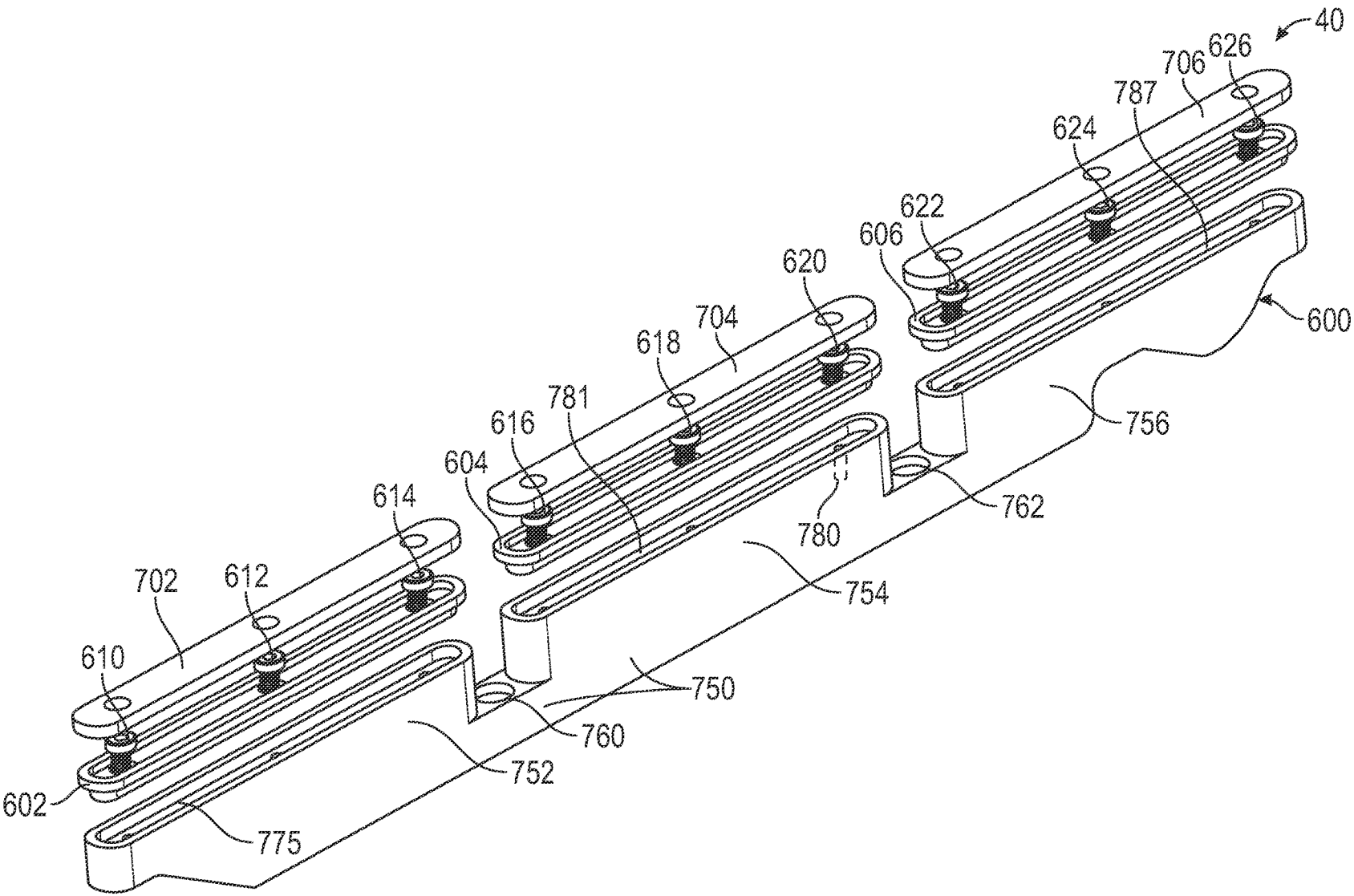
FIG. 20 is an exploded view of a gripper assembly utilized in the chuck assembly of FIG. 5.

Referring to FIG. 20, the gripper housing 600 includes a central portion 750 and extension portions 752, 754, 756. The extension portions 752, 754, 756 are integrally coupled to the central portion 750 and extend in a first direction from the central portion 750. The central portion 750 includes apertures 760, 762 extending therethrough for receiving respective bolts therethrough for coupling the gripper housing 600 to the tubular wall 22. The extension portions 752, 754, 756 extend through the apertures 141, 142, 143 (shown in FIG. 12) of the tubular wall 22.

Extension Portions

Figure 21:
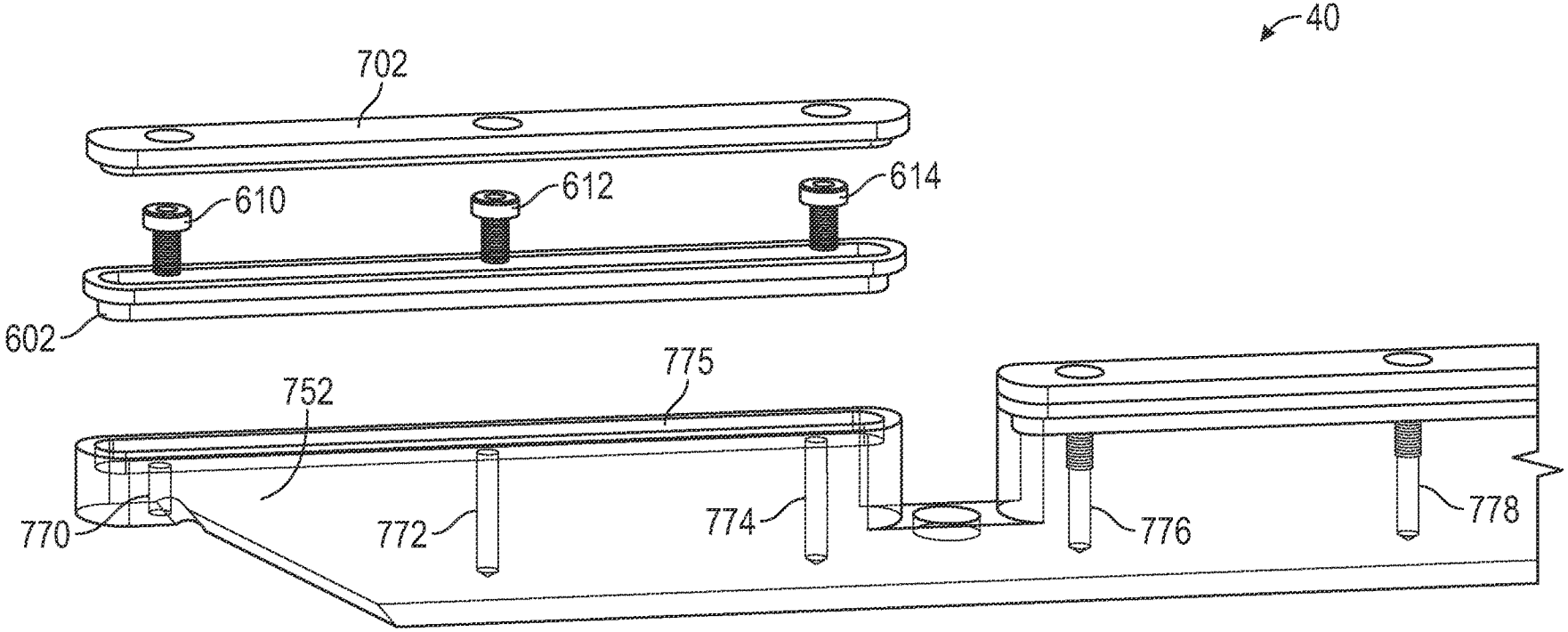
FIG. 21 is another exploded view of a portion of the gripper assembly of FIG. 20.

Referring to FIGS. 20 and 21, the extension portion 752 includes a groove 775 extending therein. The extension portion 752 further includes apertures 770, 772, 774 extending therein that communicate with the groove 775.

Figure 22:
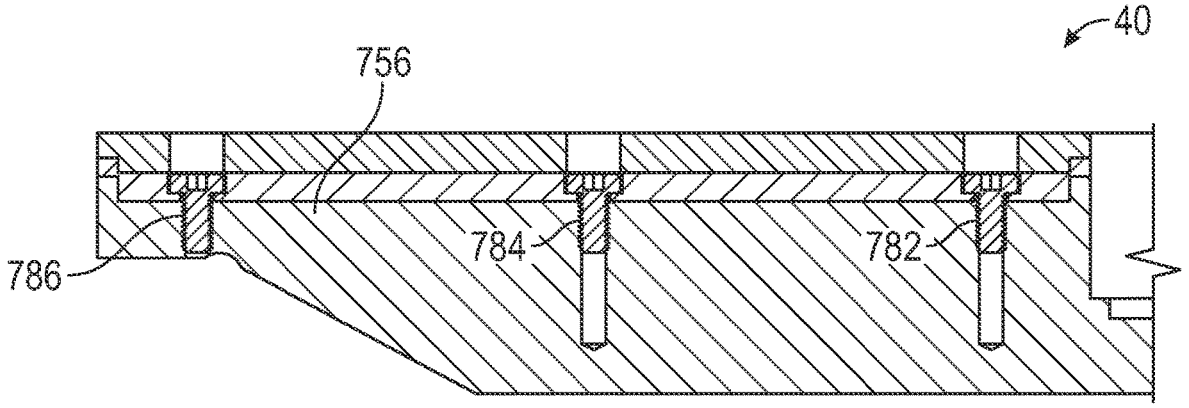
FIG. 22 is an assembled view of a portion of the gripper assembly of FIG. 20.
Figure 23:
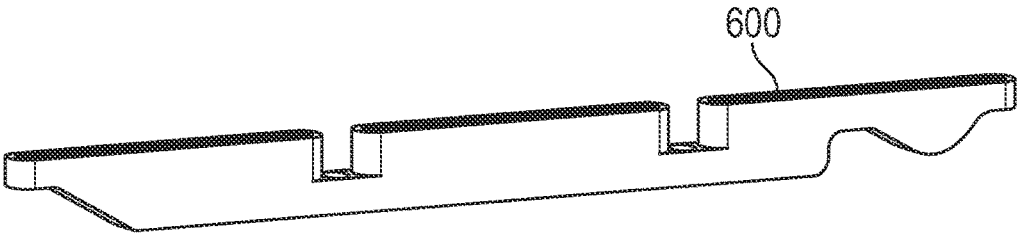
FIG. 23 is an isometric view of a gripper housing utilized in the gripper assembly of FIG. 20.

Referring to FIGS. 20 and 22, the extension portion 754 includes a groove 781 extending therein. The extension portion 752 further includes apertures 776, 778, 780 extending therein that communicate with the groove 781.

The extension portion 756 includes a groove 787 extending therein. The extension portion 756 further includes apertures 782, 784, 786 extending therein that communicate with the groove 787.

Replaceable Gripper Blocks

Figure 24:
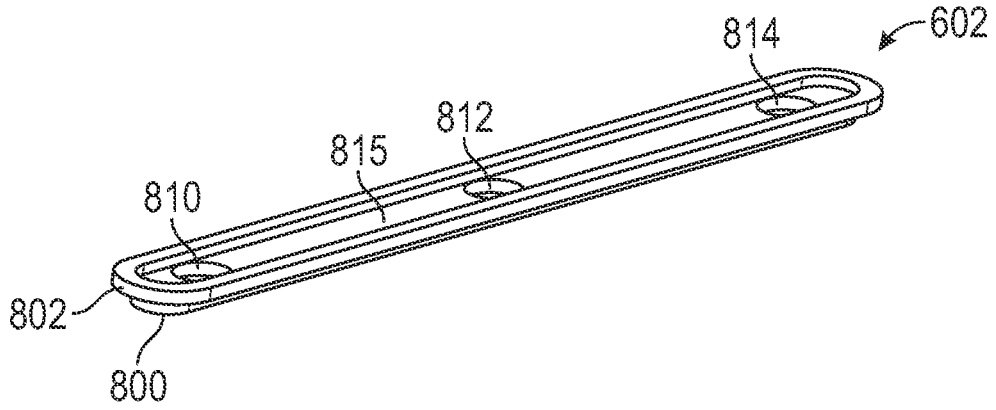
FIG. 24 is an isometric view of a first replaceable gripper block utilized in the gripper assembly of FIG. 20.

Referring to FIGS. 20 and 24, the replaceable gripper block 602 is coupled to the gripper housing 600, and is further provided to hold the replaceable rubber pad 702 thereon. The replaceable gripper block 602 includes an insertion portion 800 and a lip portion 802 integrally formed with the insertion portion 800. The lip portion 802 defines a groove 815 therein. The insertion portion 800 includes apertures 810, 812, 814 extending therethrough that communicate with the groove 815. The insertion portion 800 is disposed within the groove 775 of the extension portion 752. Further, bolts 610, 612, 614 are disposed through the apertures 810, 812, 814, respectively, in the replaceable gripper block 602 and the apertures 770, 772, 774 (shown in FIG. 21) respectively, in the gripper housing 600 to couple the replaceable gripper block 602 to the gripper housing 600.

Figure 25:
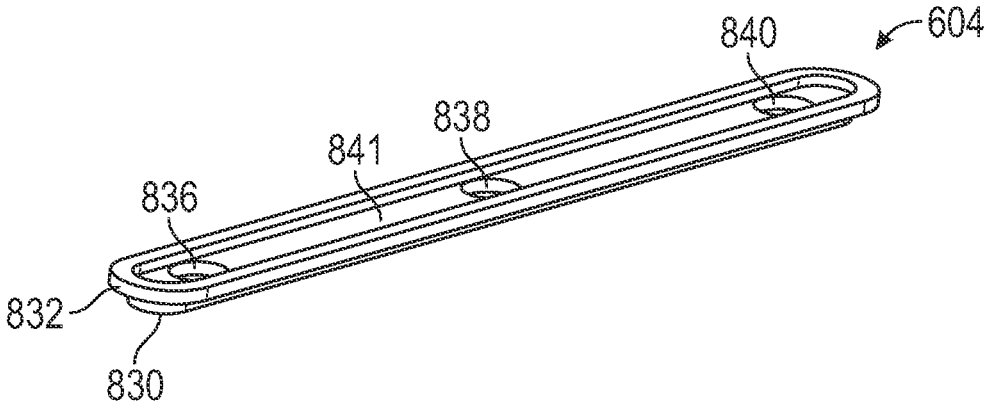
FIG. 25 is an isometric view of a second replaceable gripper block utilized in the gripper assembly of FIG. 20.

Referring to FIGS. 20 and 25, the replaceable gripper block 604 is coupled to the gripper housing 600, and is further provided to hold the replaceable rubber pad 704 thereon. The replaceable gripper block 604 includes an insertion portion 830 and a lip portion 832 integrally formed with the insertion portion 830. The lip portion 832 defines a groove 841 therein. The insertion portion 830 includes apertures 836, 838, 840 extending therethrough that communicate with the groove 841. The insertion portion 830 is disposed within the groove 781 of the extension portion 754. Further, bolts 616, 618, 620 are disposed through the apertures 836, 838, 840, respectively, in the replaceable gripper block 604 and the apertures 776, 778, 780 (shown in FIGS. 20 and 21) respectively, in the gripper housing 600 to couple the replaceable gripper block 604 to the gripper housing 600.

Figure 26:
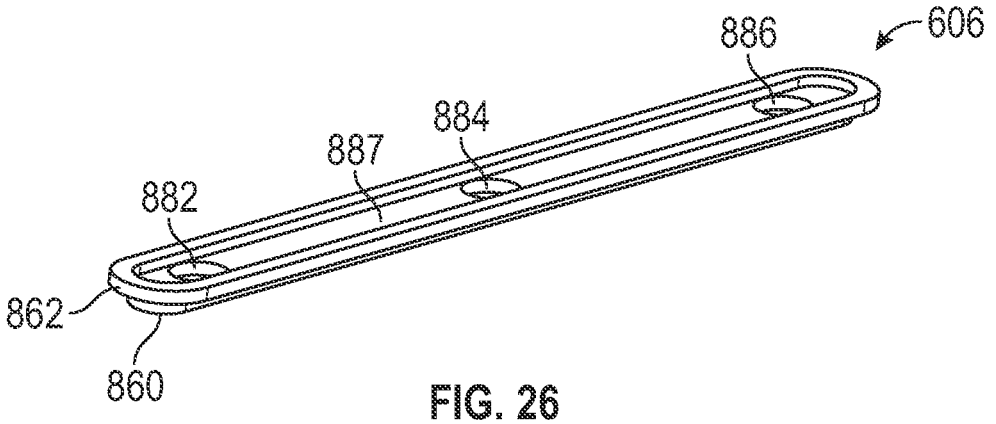
FIG. 26 is an isometric view of a third replaceable gripper block utilized in the gripper assembly of FIG. 20.

Referring to FIGS. 20 and 26, the replaceable gripper block 606 is coupled to the gripper housing 600, and is further provided to hold the replaceable rubber pad 706 thereon. The replaceable gripper block 606 includes an insertion portion 860 and a lip portion 862 integrally formed with the insertion portion 860. The lip portion 862 defines a groove 887 therein. The insertion portion 860 includes apertures 882, 884, 886 extending therethrough that communicate with the groove 887. The insertion portion 860 is disposed within the groove 787 of the extension portion 756. Further, bolts 622, 624, 626 are disposed through the apertures 882, 884, 886, respectively, in the replaceable gripper block 606 and the apertures 782, 784, 786 (shown in FIG. 22) respectively, in the gripper housing 600 to couple the replaceable gripper block 606 to the gripper housing 600.

Replaceable Rubber Pads

Figure 27:
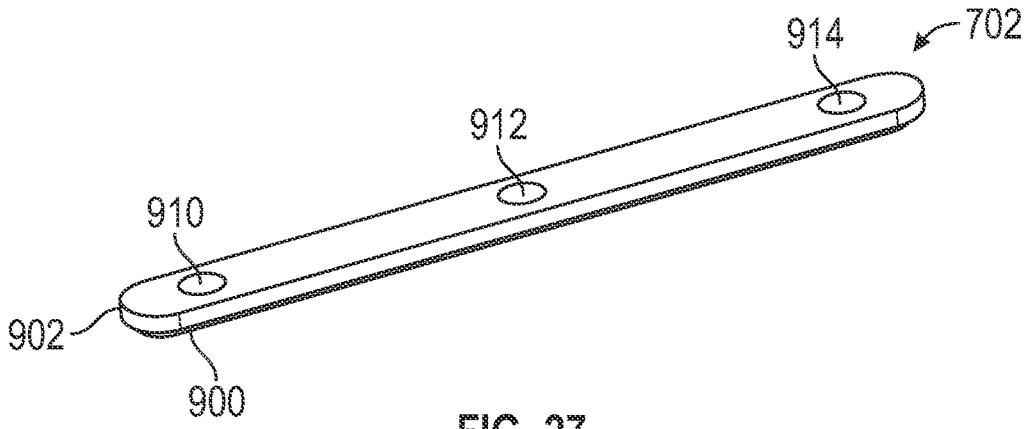
FIG. 27 is an isometric view of a first replaceable rubber pad utilized in the gripper assembly of FIG. 20.

Referring to FIGS. 20, 24 and 27, the replaceable rubber pad 702 is provided to contact an inner surface of the reel 14. The replaceable rubber pad 702 is coupled to the replaceable gripper block 602. The replaceable rubber pad 702 includes an insertion portion 900 and an outer portion 902 integrally formed with the insertion portion 900. The replaceable rubber pad 702 further includes apertures 910, 912, 914 that extend through the insertion portion 900 and the outer portion 902. The insertion portion 900 is disposed within the groove 815 of the replaceable gripper block 602. The apertures 910, 912, 914 allow the bolts 610, 612, 614 to be received therethrough.

Figure 28:
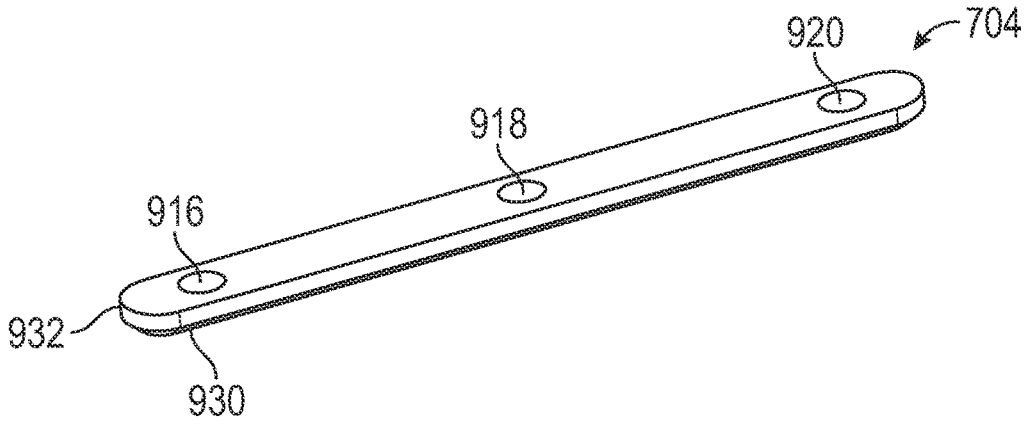
FIG. 28 is an isometric view of a second replaceable rubber pad utilized in the gripper assembly of FIG. 20.

Referring to FIGS. 20, 25 and 28, the replaceable rubber pad 704 is provided to contact an inner surface of the reel 14. The replaceable rubber pad 704 is coupled to the replaceable gripper block 604. The replaceable rubber pad 704 includes an insertion portion 930 and an outer portion 932 integrally formed with the insertion portion 930. The replaceable rubber pad 704 further includes apertures 916, 918, 920 that extend through the insertion portion 930 and the outer portion 932. The insertion portion 930 is disposed within the groove 841 of the replaceable gripper block 604. The apertures 916, 918, 920 allow the bolts 616, 618, 620 to be received therethrough.

Figure 29:
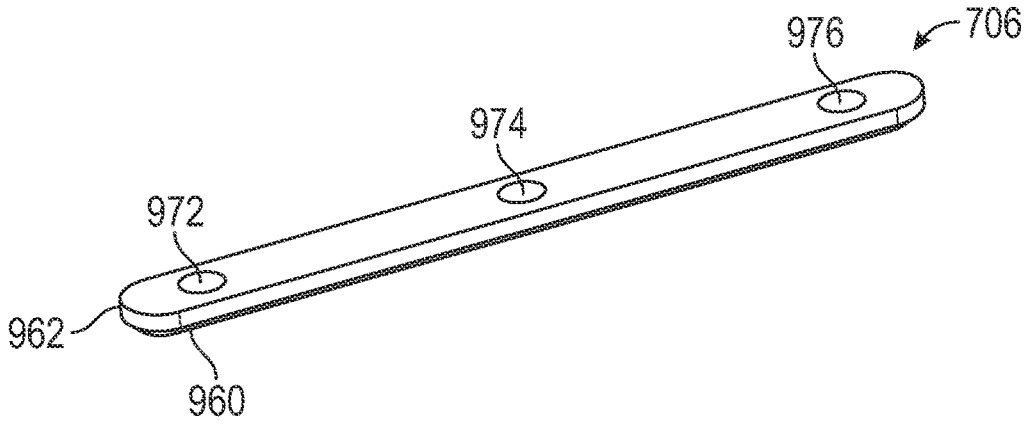
FIG. 29 is an isometric view of a third replaceable rubber pad utilized in the gripper assembly of FIG. 20.

Referring to FIGS. 20, 26 and 29, the replaceable rubber pad 706 is provided to contact an inner surface of the reel 14. The replaceable rubber pad 706 is coupled to the replaceable gripper block 606. The replaceable rubber pad 706 includes an insertion portion 960 and an outer portion 962 integrally formed with the insertion portion 960. The replaceable rubber pad 706 further includes apertures 972, 974, 976 that extend through the insertion portion 960 and the outer portion 962. The insertion portion 960 is disposed within the groove 887 of the replaceable gripper block 606. The apertures 972, 974, 976 allow the bolts 622, 624, 626 to be received therethrough.

Referring to FIGS. 5, 6 and 10, the gripper assemblies 40, 41 are disposed 60 degrees apart from one another relative to the longitudinal axis 47 (shown in FIG. 5). Further, the gripper assemblies 41, 42 are disposed 60 degrees apart from one another relative to the longitudinal axis 47. Also, the gripper assemblies 42, 43 are disposed 60 degrees apart from one another relative to the longitudinal axis 47. Further, the gripper assemblies 43, 44 our disposed 60 degrees apart from one another relative to the longitudinal axis 47. Also, the gripper assemblies 44, 45 are disposed 60 degrees apart from one another relative to the longitudinal axis 47.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A chuck assembly for holding a reel, comprising:

a tubular wall defining a central hole therethrough, the tubular wall extending along a longitudinal axis, the tubular wall further having first and second apertures extending therethrough that communicate with the central hole;

a flange member being coupled to a first end portion of the tubular wall;

first, second, third, fourth, fifth, and sixth ball roller assemblies being coupled to the tubular wall;

first, second, third, fourth, fifth, and sixth gripper assemblies being coupled to the tubular wall;

the second ball roller assembly being spaced 60 degrees apart from the first ball roller assembly relative to the longitudinal axis and being disposed between the first and second gripper assemblies;

the third ball roller assembly being spaced 60 degrees apart from the second ball roller assembly relative to the longitudinal axis and being disposed between the second and third gripper assemblies;

the fourth ball roller assembly being spaced 60 degrees apart from the third ball roller assembly relative to the longitudinal axis and being disposed between the third and fourth third gripper assemblies;

the fifth ball roller assembly being spaced 60 degrees apart from the fourth ball roller assembly relative to the longitudinal axis and being disposed between the fourth and fifth gripper assemblies;

the sixth ball roller assembly being spaced 60 degrees apart from the fifth ball roller assembly relative to the longitudinal axis and being disposed between the fifth and sixth gripper assemblies; and the first ball roller assembly being spaced 60 degrees apart from the sixth ball roller assembly relative to the longitudinal axis and being disposed between the first and sixth gripper assemblies;

the first ball roller assembly being at least partially disposed in the first aperture, the first ball roller assembly having a first ball roller and a first ball roller block, the first ball roller being disposed on the first ball roller block such that an outer surface of a ball bearing of the first ball roller extends radially outwardly from an outer surface of the tubular wall a first predetermined distance and contacts the reel.

2. The chuck assembly of claim 1, wherein:

the first predetermined distance is at least 1 millimeter.

3. The chuck assembly of claim 1, wherein:

the first gripper assembly being disposed at least partially in the second aperture, the first gripper assembly having a first gripper housing, a first replaceable gripper block, and a first replaceable rubber pad; the first gripper housing being coupled to the tubular wall, the first replaceable gripper block being coupled to the first gripper housing, the first replaceable rubber pad being coupled to the first replaceable gripper block such that an outer surface of the first replaceable rubber pad extends radially outwardly from the outer surface of the tubular wall a second predetermined distance.

4. The chuck assembly of claim 1, wherein:

the first and second gripper assemblies being disposed 60 degrees apart from one another relative to the longitudinal axis;

the second and third gripper assemblies being disposed 60 degrees apart from one another relative to the longitudinal axis;

the third and fourth gripper assemblies being disposed 60 degrees apart from one another relative to the longitudinal axis;

the fourth and fifth gripper assemblies being disposed 60 degrees apart from one another relative to the longitudinal axis; and the fifth and sixth gripper assemblies being disposed 60 degrees apart from one another relative to the longitudinal axis.

5. A chuck assembly for holding a reel, comprising:

a tubular wall defining a central hole therethrough, the tubular wall extending along a longitudinal axis;

a flange member being coupled to a first end portion of the tubular wall;

first, second, and third ball roller assemblies being coupled to the tubular wall, the first, second, and third ball roller assemblies being disposed apart from one another at a respective predetermined angle about the longitudinal axis; and first, second, and third gripper assemblies being coupled to the tubular wall, the first, second, and third gripper assemblies being disposed apart from one another at the respective predetermined angle about the longitudinal axis; and each of the first, second, and third ball roller assemblies having a respective ball bearing with an outer surface of the respective ball bearing extending radially outwardly from an outer surface of the tubular wall a first predetermined distance and contacting the reel.

6. The chuck assembly of claim 5, wherein:

the first gripper assembly is disposed between the first and second ball roller assemblies;

the second gripper assembly is disposed between the second and third ball roller assemblies; and the third gripper assembly is disposed between the third and first roller assemblies.

7. The chuck assembly of claim 5, wherein:

each respective predetermined angle is 60 degrees.

8. The chuck assembly of claim 5, wherein:

each respective predetermined angle is 120 degrees.

9. The chuck assembly of claim 5, further comprising:

fourth, fifth, and sixth ball roller assemblies being coupled to the tubular wall, the fourth, fifth, and sixth ball roller assemblies being disposed apart from one another at the respective predetermined angle about the longitudinal axis; and fourth, fifth, and sixth gripper assemblies being coupled to the tubular wall, the fourth, fifth, and sixth gripper assemblies being disposed apart from one another at the respective predetermined angle about the longitudinal axis.

10. The chuck assembly of claim 9, wherein:

each respective predetermined angle is 60 degrees.

* * * * *